United States Patent [19]

Coty

[11] 4,383,350

[45] May 17, 1983

[54] RELEASABLE THEFT PROTECTION DEVICE

[76] Inventor: Raymond J. A. Coty, 5B Drummond Dr., Rocky Hill, Conn. 06067

[21] Appl. No.: 294,083

[22] Filed: Aug. 19, 1981

[51] Int. Cl.[3] ..... A44B 19/00

[52] U.S. Cl. ..... 24/230 R

[58] Field of Search ..... 24/230 R; 119/110; 224/26

[56] References Cited

U.S. PATENT DOCUMENTS

| | | | |
|---|---|---|---|
| 2,783,926 | 3/1957 | Wise | 224/26 |
| 3,540,089 | 11/1970 | Franklin | 119/110 |
| 3,949,915 | 4/1976 | Burhans | 224/26 K |
| 4,140,164 | 2/1979 | Staup | 150/28 R |

FOREIGN PATENT DOCUMENTS

| | | | |
|---|---|---|---|
| 64466 | 4/1913 | Switzerland | 24/230 R |
| 23071 | of 1895 | United Kingdom | 24/230 |

*Primary Examiner*—Gene Mancene
*Assistant Examiner*—Wenceslao J. Contreras
*Attorney, Agent, or Firm*—Henderson & Sturm

[57] ABSTRACT

This invention relates in general to a theft protection device for hand or shoulder carried articles, such as cameras, purses, etc., and more specifically to at least one predetermined force responsive attachment device, which has one component attached to the article alone, and the other component attached to the carrying straps, and both components are adapted for releasable engagement with one another, upon the application of a predetermined amount of force.

10 Claims, 4 Drawing Figures

RELEASABLE THEFT PROTECTION DEVICE

BACKGROUND OF THE INVENTION

A serious problem involved with the carrying of articles such as handbags, cameras, briefcases, etc., is that while the method of carrying such items is designed to be both fashionable and convenient; no method to date has been designed to accomplish both purposes, while at the same time providing security against the loss of the article being carried, and yet still provide some degree of protection to the user.

An example of such prior art devices may be seen by reference to Staup, U.S. Pat. No. 4,140,164, in which the entire pocketbook breaks away and falls apart, whenever a purse snatching attempt is made. This method while not only difficult to manufacture, allows for the accidental spillage of its contents during normal usage.

A further example can be seen in Gist, U.S. Pat. No. 3,881,534, which shows a pocketbook having a detachable inner purse, which must be connected to the user via a cord and bracelet arrangement. This method may work in some cases, but at times when the purse snatchers travel in pairs or gangs, the attached cord and bracelet would allow the remainder of the gang to grab the inner purse, which is secured to the user thereby causing unnecessary and potentially grave physical injury to the user.

Another example is shown in Burhans, U.S. Pat. No. 3,949,915, wherein a flexible anchor member is securely attached to both the handbag and the users waist. This arrangement also allows for serious injury to the victim of a purse snatching, not only by allowing them to be pulled off balance, and forced to the ground, but also raises the distinct possibility that the thieves, after seeing the victim on the ground, might take advantage of that situation to further harm the victim during the course of the crime.

A yet further example can be seen by reference to Wise, U.S. Pat. No. 2,783,926. This example shows a single flexible anchoring member, with means to secure the item being carried, to two separate areas of the users apparel. This again makes no provision for the safety of the user, or the safe return of the article.

To date no one has devised a device, which will initially resist the separation of an article from the user's person up to a point, and then will rapidly release the article, when predetermined force has been reached, so as to protect the user from undue physical harm as well as financial loss.

SUMMARY OF THE INVENTION

An object of the present invention is the provision of a force releasable attaching means, between a carrying strap and an article supported by the strap, wherein the article will remain attached to the strap under normal usage.

Another object of the present invention is the provision of a theft prevention device which will retain a supporting strap and article in the assembled relationship until a predetermined amount of force is exerted on either the strap or the article.

Still another object of the present invention is the provision of a releasable attachment means between a carrying strap and supported article, which will detach the strap from the article when a predetermined amount of force is exerted on either the strap or the article.

A further object of the instant invention is the provision of a theft protection device, which is particularly well suited for older people, in that they are susceptible to broken bones from falls due to losing their balance, and this device will allow an article to be yanked from their grasp without toppling them over.

A still further object of the present invention is the provision of a releasable anti-theft device, which by virtue of its disposition at the juncture of the strap and article, will in most instances leave the purse-snatcher holding only the strap or nothing at all.

Another object of the instant invention is the provision of a device that will operate such that if a thief should grab the item being carried and run away, the abnormal pull would allow the item to release from the handle or shoulder strap and therefore not cause any physical injury to the person carrying the item.

Still another object of the invention is the provision that if a thief grabs the handle and runs away, he or she would then see that there main objective has been left behind while considerable attention has been brought upon themselves, and at this time they will discard the strap or handle which then can be reattached to its original item.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
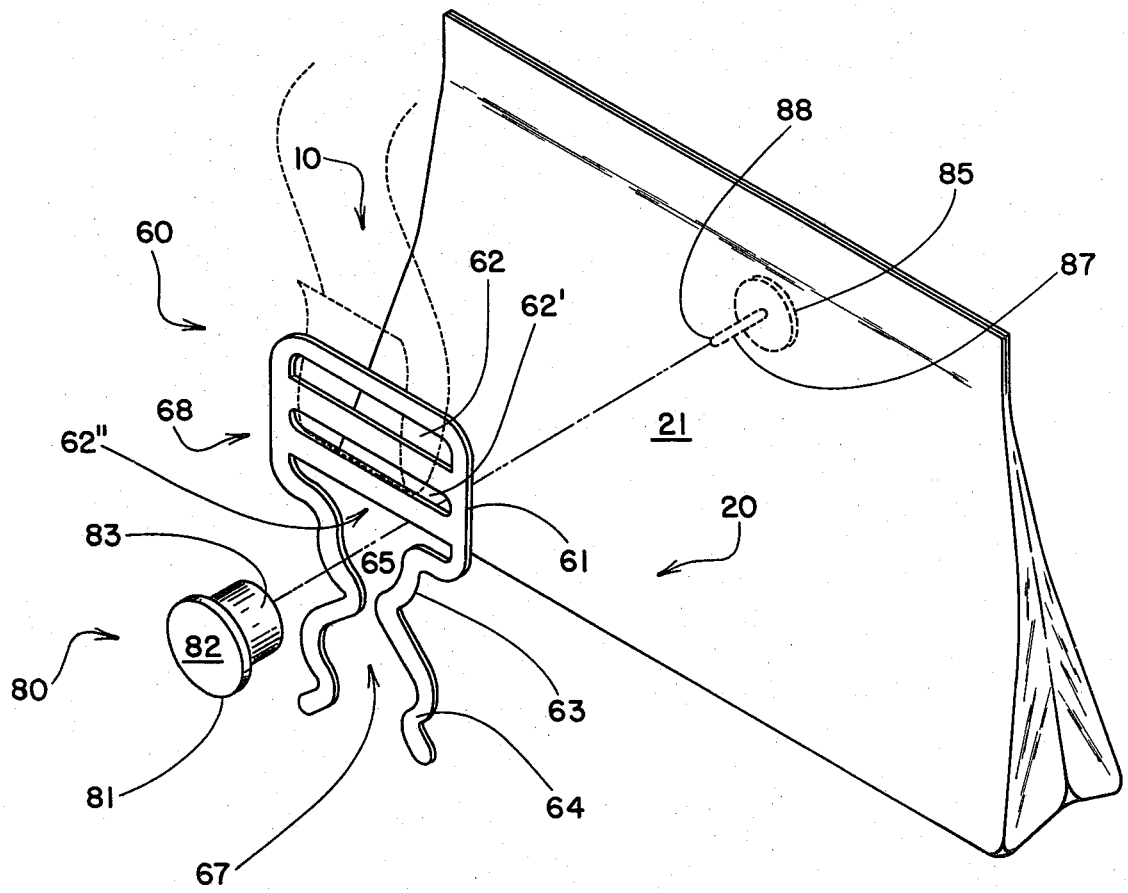
FIG. 1 is a perspective view of the present invention as it would appear disposed on a pocketbook.

The anti-theft device which comprises the present invention is designed to be used in conjunction with a carrying strap 10, which supports an article 20, such as the pocketbook 21, illustrated in FIG. 1. This device, designated generally as 50, can be incorporated into any article 20, which requires a strap or handle member, for the purpose of supporting or carrying the article, on or by the user.

Since most purse-snatchers use speed and force to perpetrate their crimes, as opposed to stealth and cunning, this device has been developed to take advantage of these facts, to frustrate the criminal intent and render it fruitless.

Most articles 20 such as cameras, pocketbooks, purses, etc., are provided with straps 10, which are affixed thereto in a relatively permanent manner. This particular invention, however, uses this commonly accepted fact, to produce a wholly unexpected result, for a person attempting to forcibly take the article away from its rightful owner.

The releasable attachment device 50, comprises two major components, which are normally engaged during use, and form the physical attachment between the strap 10 and the article 20. The first major component 60 comprises a strap receiving member 61, having in the preferred embodiment one or more apertures 62, which are dimensioned to receive a portion of the strap 10 in a relatively permanent fashion. One end of the strap 10 is intended to be inserted thru at least one of the apertures 62, and then secured to itself, in the form of a loop by stitching, adhesives, clamps, rivets, etc. The free end 63 of the first major component 60 comprise two formed spring wire legs 64, which are designed to releasably engage the second major component 80, which will be described in greater detail further on.

Figure 4:
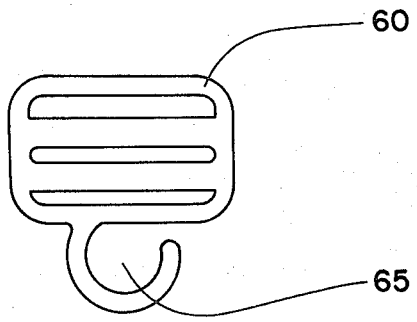
FIG. 4 is a detailed view of an alternative configuration for the first major component, which is attached to the carrying strap.

Referring back to the apertures 62 it should be appreciated from FIGS. 1 and 4, that the upper portion 68 of major component 60 is formed in the shape of a common buckle, with the apertures 62, and 62' performing their normal function in retaining the strap 10 in the usual fashion. It should further be appreciated that aperture 62'', while also serving its normal purpose, serves the dual function of forming a part of the second major component receiving means 65, on the lower portion 66 of the first major component 60. This second major component receiving means 65 is formed by the spring wire legs 64, which initially converge towards their free ends to form receiving means 65, and then diverge to form a guide means 67 which terminates in the outwardly flared and rounded ends of the legs 64.

While the major component 60 has been described and illustrated as a buckle, it should be appreciated that the upper portion 68 can assume the shape of any strap fastening means, such as a clasp, rivet, clamp, etc., as long as the spring legs 64 are formed integrally therewith, and perform the same function as attributed to the structure described in the preferred embodiment.

In this vein, it should be noted that it would not be necessary for there to be plural spring legs 64, in as much as, a generally C-shaped single spring leg, as shown in FIG. 4, would function just as well, as would undoubtedly other configurations. Suffice it to say, that it is imperative to the operation of this invention, that a deformable spring member 64 be operatively connected to the free end of the first major component 60, and form a releasable receiving means 65 for the second major component 80.

Figure 3:
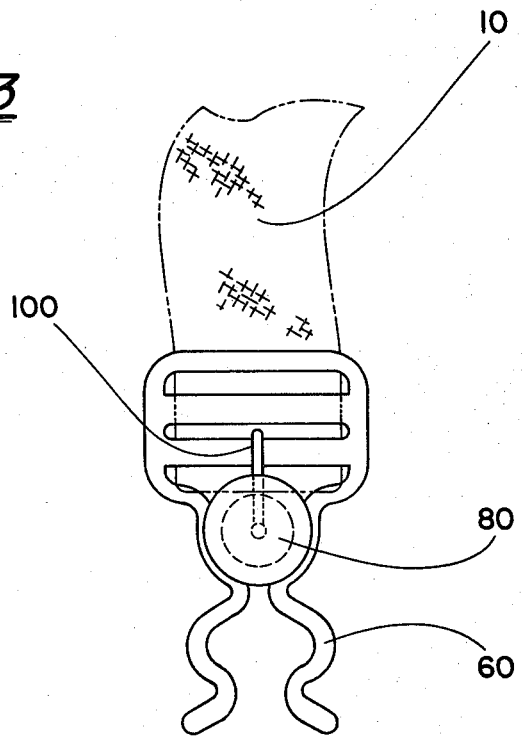
FIG. 3 is a detailed front view of the present invention as it would appear to the naked eye.

As can best be seen by reference to FIG. 3, the second major component 80 comprises a button member 81 having an enlarged head 82, and a reduced diameter collar 83. The collar 83 is further provided with a recess or aperture 84, which is dimensioned to receive a fastening member 85, to permanently affix the button 81 to the article 20. The fastening member 85, comprises an elongated centrally disposed shaft 87 which terminates in a pointed end 88.

The second major component 80, is affixed to the article 20 in the following manner; the button member 81 is disposed on the outside surface of the article 20, at a point where a strap 10 would normally be attached with the collar contacting the article surface; the fastening member 85 is disposed on the inside surface of the article 20, and the pointed end 88 penetrates the article material 21, to matingly engage the aperture 84 of the bottom member 81.

Figure 2:
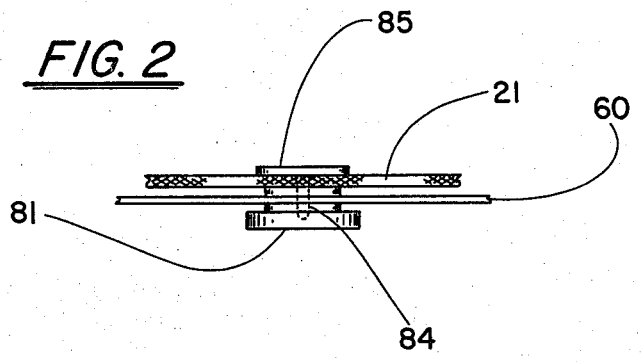
FIG. 2 is a cross-sectional view taken thru the pocketbook showing the disposition of the respective elements in their assembled relationship.

As can be seen in FIG. 2, the button collar 83 and the enlarged head 86 of the fastening member 85 grasp the article material 21 in tight frictional engagement, when the respective members 81 and 85 are secured together, and they are intended to be a permanent fixture on the article 20, after they have been joined.

Again it should be appreciated that the exact structure of the second major component 80 may vary quite a bit in actual practice, and the major criteria for this component, is that it be permanently affixed to the article 20, and be provided with a recessed or reduced diameter surface, such as collar 82, which will cooperate with the component receiving means 65, on the first major component.

Once the major components have been attached to the strap and article respectively, they can be joined to form the instant invention. Since it should be obvious, that the first and second major components will normally be installed at the two locations, where a strap 10 is normally connected to an article 20, the cooperation between the major components at only one such location will be described herein.

The collar 83 of the second major portion 80 is inserted into the guide means 67 formed by the spring wire legs 64 of the first major component. When the reduced portion or collar 83 of the second major component reaches the mouth of the receiving means 65 of the first major component, a predetermined amount of force is required to overcome the spring biasing of the spring wire legs 64, to force them apart, and insert the reduced portion 83 into the receiving means 65. Once the components have been assembled, the enlarged head 82 of the bottom member will axially retain the second component in the receiving means 65 during normal usage, and the spring biasing of the legs 64 will likewise vertically retain the reduced collar therein.

Should a purse-snatcher attempt to grab a combined article and carrying strap having this invention installed thereon, the major components will cooperate in the manner illustrated in FIG. 3. Since the most accessible portion to grasp will normally be the strap portion, it will be this portion to which the abnormal force will be applied. The sudden force, when it reaches a predetermined amount, will overcome the spring biasing of the spring formed legs 64 to rapidly disengage either or both ends of the strap 10 from the article 20, leaving the would-be-thief, in most instances, with nothing more than a worthless strap for his efforts. In addition since surprise, speed, and an instant escape are major factors in most successful purse snatchings, it is highly unlikely that the thief will take the precious time required to return to the potential victim, particularly since the element of surprise has been eliminated, and he will have already drawn undue attention to himself, which could lead to his apprehension, should he remain in the vicinity any longer.

Of the two major components, the first major component is the most crucial, particularly with respect to the deformable spring member 64, which forms the releasable receiving means 65. This invention contemplates fabrication of the spring member 64, having light, medium and heavy release values, so that the purchaser can choose the amount of predetermined force necessary to disengage the major components based on their physical size, strength, age and sex. Obviously the lighter release forces (e.g. 10–20 lbs.) would be chosen by older men and women, the medium force (e.g. 20–40 lbs.) would be chosen primarily by younger women, having an average build, and the heavier release force (40 lbs. and above) would be chosen by younger males and larger females.

In addition, as can be seen in FIG. 3, a frangible filament or strand 100 can be secured between the first major component 60 and the second major component 80. This filament or strand 100 would have a tensile or breaking strength slightly less than the release force of the spring wire legs 64; and is intended as a back-up device to hold the carrying straps and article together, should the release force of the spring wire legs weaken, over a period of time, or through repeated usage.

The primary intent of the present invention is to retain the strap and article in the assembled relationship during normal usage, and also up to the point where a predetermined amount of force has been applied between the strap and the article, whereupon the respective parts will rapidly disengage, either simultaneously or sequentially depending on the amount and duration of the force applied.

Having thereby disclosed the subject matter of this invention it should be obvious that many modifications, substitutions and variations of the invention are possible in light of the above teachings. It is therefore to be understood, that the invention may be practised other than as specifically described, and should be limited only by the breadth and scope of the appended claims.

What I claim is:

1. A theft prevention device for an article, such as a purse, which is designed to be supported by a strap, comprising:

a first major component connected to at least one end of the strap, a second major component connected to said article, and adapted to be releasably connected to said first major component, to form a connection between said one end of said strap and said article under normal usage, and a frangible filament secured between the first major component, and the second major component.

2. A device as in claim 1; wherein, said first major component has an upper portion connected to said strap, and a lower portion which forms a second major component receiving means.

3. A device as in claim 2; wherein, the second major component receiving means comprises a deformable spring element.

4. A device as in claim 3; wherein, the second major component comprises an enlarged head having a reduced portion which is dimensioned to be received within said receiving means.

5. A device as in claim 4; wherein, said deformable spring element comprises a pair of formed spring legs.

6. A device as in claim 3; wherein, the application of a predetermined amount of force between the strap and article will deform the spring element to disengage the connection between the said one end of the strap and the article.

7. A device as in claim 6; wherein, the predetermined amount of force does not exceed 20 lbs.

8. A device as in claim 6; wherein, the predetermined amount of force does not exceed 40 lbs.

9. A device as in claim 6; wherein, the predetermined amount of force is not less than 40 lbs.

10. A device as in claim 6; wherein, the application of the same predetermined amount of force between the first major component and the second major component is necessary to establish the connection between the respective components.

* * * * *